US009518471B2

(12) United States Patent
Hansen et al.

(10) Patent No.: US 9,518,471 B2
(45) Date of Patent: Dec. 13, 2016

(54) LOCKING SPACER ASSEMBLY

(71) Applicant: General Electric Company, Schenectady, NY (US)

(72) Inventors: Christian Michael Hansen, Simpsonville, SC (US); Michael James Healy, Greenville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 529 days.

(21) Appl. No.: 14/055,106

(22) Filed: Oct. 16, 2013

(65) Prior Publication Data

US 2015/0101349 A1 Apr. 16, 2015

(51) Int. Cl.
*F01D 5/32* (2006.01)
*F01D 5/30* (2006.01)

(52) U.S. Cl.
CPC ..... *F01D 5/303* (2013.01); *F01D 5/3053* (2013.01); *F01D 5/32* (2013.01); *F01D 5/3038* (2013.01); *F05D 2240/80* (2013.01); *F05D 2260/30* (2013.01)

(58) Field of Classification Search
CPC ..... F01D 5/3023; F01D 5/303; F01D 5/32; F01D 5/3007; F01D 5/3038; F01D 5/3053; F01D 5/323; F01D 5/326; F05D 2260/30; F04D 29/32234; F04D 29/322; F04D 29/34; F02C 3/04
See application file for complete search history.

(56) References Cited

U.S. PATENT DOCUMENTS

| | | | | |
|---|---|---|---|---|
| 3,627,448 | A | 12/1971 | Rupp | |
| 4,684,325 | A | 8/1987 | Arnold | |
| 4,859,149 | A | 8/1989 | McClain | |
| H1258 | H | 12/1993 | Hindle, Jr. | |
| 6,135,717 | A | 10/2000 | Sokol et al. | |
| 6,638,006 | B2 | 10/2003 | Selby | |
| 6,929,453 | B2 | 8/2005 | Kite | |
| 7,114,927 | B2 | 10/2006 | Bachofner | |
| 7,435,055 | B2 | 10/2008 | Hansen | |
| 7,581,931 | B2 | 9/2009 | Shaefer | |
| 8,176,598 | B2 | 5/2012 | Casavant et al. | |
| 2001/0022936 | A1 | 9/2001 | Zimmermamm | |
| 2004/0037703 | A1 | 2/2004 | Arinci | |
| 2005/0106019 | A1 * | 5/2005 | Lardellier | F01D 5/00 416/96 R |

(Continued)

*Primary Examiner* — Phutthiwat Wongwian
*Assistant Examiner* — Marc Amar
(74) *Attorney, Agent, or Firm* — Dority & Manning, P.A.

(57) ABSTRACT

Locking spacer assemblies, rotor assemblies and turbomachines are provided. In one embodiment, a locking spacer assembly includes a first end piece and a second end piece each configured to fit into a space between platforms of adjacent rotor blades, the first end piece and second end piece each comprising an outer surface and an inner surface, the outer surface having a profile adapted to project into an attachment slot, wherein the inner surfaces of the first and second end pieces generally face each other. The locking spacer assembly further includes an actuator movable between the inner surfaces, the actuator comprising a projection, the projection comprising a first surface and a second surface formed on the projection and configured to engage the inner surfaces, the first and second surfaces generally perpendicular to radial.

15 Claims, 7 Drawing Sheets

(56) References Cited

U.S. PATENT DOCUMENTS

| | | | | |
|---|---|---|---|---|
| 2007/0280831 | A1 | 12/2007 | Pickens | |
| 2009/0016889 | A1 | 1/2009 | Krutzfeldt et al. | |
| 2011/0110782 | A1* | 5/2011 | Brittingham ..... | F01D 5/3038 416/215 |
| 2011/0164983 | A1 | 7/2011 | Garcia-Crespo et al. | |
| 2011/0255978 | A1* | 10/2011 | Potter ..... | F01D 5/3038 416/204 A |
| 2015/0101346 | A1 | 4/2015 | Foster et al. | |
| 2015/0101347 | A1 | 4/2015 | Potter et al. | |
| 2015/0101348 | A1 | 4/2015 | Hansen et al. | |
| 2015/0101350 | A1 | 4/2015 | Healy et al. | |
| 2015/0101351 | A1 | 4/2015 | Healy et al. | |

* cited by examiner

LOCKING SPACER ASSEMBLY

FIELD OF THE INVENTION

The present invention generally involves a turbomachine. More specifically, the invention relates to locking spacer assemblies for securing rotor blades to a rotor disk of the turbomachine.

BACKGROUND OF THE INVENTION

Various turbomachines such as a gas turbine or steam turbine include a shaft, multiple rotor disks coupled to the shaft and various rotor blades mounted to the rotor disks. A conventional gas turbine includes a rotatable shaft with various rotor blades mounted to discs in the compressor and turbine sections thereof. Each rotor blade includes an airfoil over which pressurized air, combustion gases or other fluids such as steam flows, and a platform at the base of the airfoil that defines a radially inner boundary for the air or fluid flow.

The rotor blades are typically removable, and therefore include a suitable root portion such as a T-type root portion that is configured to engage a complementary attachment slot in the perimeter of the rotor disk. The root may either be an axial-entry root or a circumferential-entry root that engages with corresponding axial or circumferential slots formed in the disk perimeter. A typical root includes a neck of minimum cross sectional area and root protrusions that extend from the root into a pair of lateral recesses located within the attachment slot.

For circumferential roots, a single attachment slot is formed between forward and aft continuous circumferential posts or hoops that extend circumferentially around the entire perimeter of forward and aft faces of the rotor disk. The cross-sectional shape of the circumferential attachment slot includes lateral recesses defined by the forward and aft rotor disk posts or hoops that cooperate with the root protrusions of the rotor blades to radially retain the individual blades during turbine operation.

In the compressor section of a gas turbine, for example, rotor or compressor blades (specifically the root component) are inserted into and around the circumferential slot and rotated approximately ninety degrees to bring the root protrusions of the rotor blades into contact with the lateral recesses to define a complete stage of rotor blades around the circumference of the rotor disks. The rotor blades include platforms at the airfoil base that may be in abutting engagement around the slot. In other embodiments, spacers may be installed in the circumferential slot between adjacent rotor blade platforms. Once all of the blades (and spacers) have been installed, a final remaining space(s) in the attachment slot is typically filled with a specifically designed spacer assembly, as generally known in the art.

A common technique used to facilitate the insertion of the final spacer assembly into the circumferential slot is to include a non-axi symmetric loading slot in the rotor disc. Various conventional spacer assemblies have been designed to eliminate the need for a loading slot in the rotor disk. However, these assemblies include complex devices. These conventional assemblies are generally difficult to assemble, costly to manufacture and may result in rotor imbalance. Accordingly, there is a need for an improved locking spacer assembly that is relatively easy to assemble within the final space between platforms of adjacent rotor blades of a turbomachine such as compressor and/or turbine rotor blades of a gas turbine.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a locking spacer assembly for insertion into a circumferential attachment slot between platforms of adjacent rotor blades is provided. The locking spacer assembly includes a first end piece configured to fit into a space between platforms of the adjacent rotor blades, the first end piece comprising an outer surface and an inner surface, the outer surface having a profile adapted to project into the attachment slot, and a second end piece configured to fit into the space between the platforms, the second end piece comprising an outer surface and an inner surface, the outer surface having a profile adapted to project into the attachment slot, wherein the inner surfaces of the first and second end pieces generally face each other. The locking spacer assembly further includes an actuator movable between the inner surfaces, the actuator comprising a projection, the projection comprising a first surface and a second surface formed on the projection and configured to engage the inner surfaces, the first and second surfaces generally perpendicular to radial.

In accordance with another embodiment of the present disclosure, a rotor assembly is provided. The rotor assembly includes a rotor disc comprising forward and aft posts defining a continuous circumferentially extending attachment slot, and a plurality of rotor blades, each of the plurality of rotor blades extending from one of a plurality of platforms, wherein each of the plurality of platforms is secured to the attachment slot by an inwardly extending root. The rotor assembly further includes a locking spacer assembly disposed in a space between at least two of the plurality of platforms. The locking spacer assembly includes a first end piece configured to fit into a space between platforms of the adjacent rotor blades, the first end piece comprising an outer surface and an inner surface, the outer surface having a profile adapted to project into the attachment slot, and a second end piece configured to fit into the space between the platforms, the second end piece comprising an outer surface and an inner surface, the outer surface having a profile adapted to project into the attachment slot, wherein the inner surfaces of the first and second end pieces generally face each other. The locking spacer assembly further includes an actuator movable between the inner surfaces, the actuator comprising a projection, the projection comprising a first surface and a second surface formed on the projection and configured to engage the inner surfaces, the first and second surfaces generally perpendicular to radial.

In accordance with another embodiment of the present disclosure, a turbomachine is provided. The turbomachine includes a compressor section, a turbine section, and a combustor section between the compressor section and the turbine section. One of the compressor section or the turbine section includes a rotor disc comprising forward and aft posts defining a continuous circumferentially extending attachment slot, and a plurality of rotor blades, each of the plurality of rotor blades extending from one of a plurality of platforms, wherein each of the plurality of platforms is secured to the attachment slot by an inwardly extending root. One of the compressor section or the turbine section further includes a locking spacer assembly disposed in a space between at least two of the plurality of platforms. The locking spacer assembly includes a first end piece configured to fit into a space between platforms of the adjacent rotor blades, the first end piece comprising an outer surface and an inner surface, the outer surface having a profile adapted to project into the attachment slot, and a second end piece configured to fit into the space between the platforms, the second end piece comprising an outer surface and an inner surface, the outer surface having a profile adapted to project into the attachment slot, wherein the inner surfaces of the first and second end pieces generally face each other. The locking spacer assembly further includes an actuator movable between the inner surfaces, the actuator comprising a projection, the projection comprising a first surface and a second surface formed on the projection and configured to engage the inner surfaces, the first and second surfaces generally perpendicular to radial.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
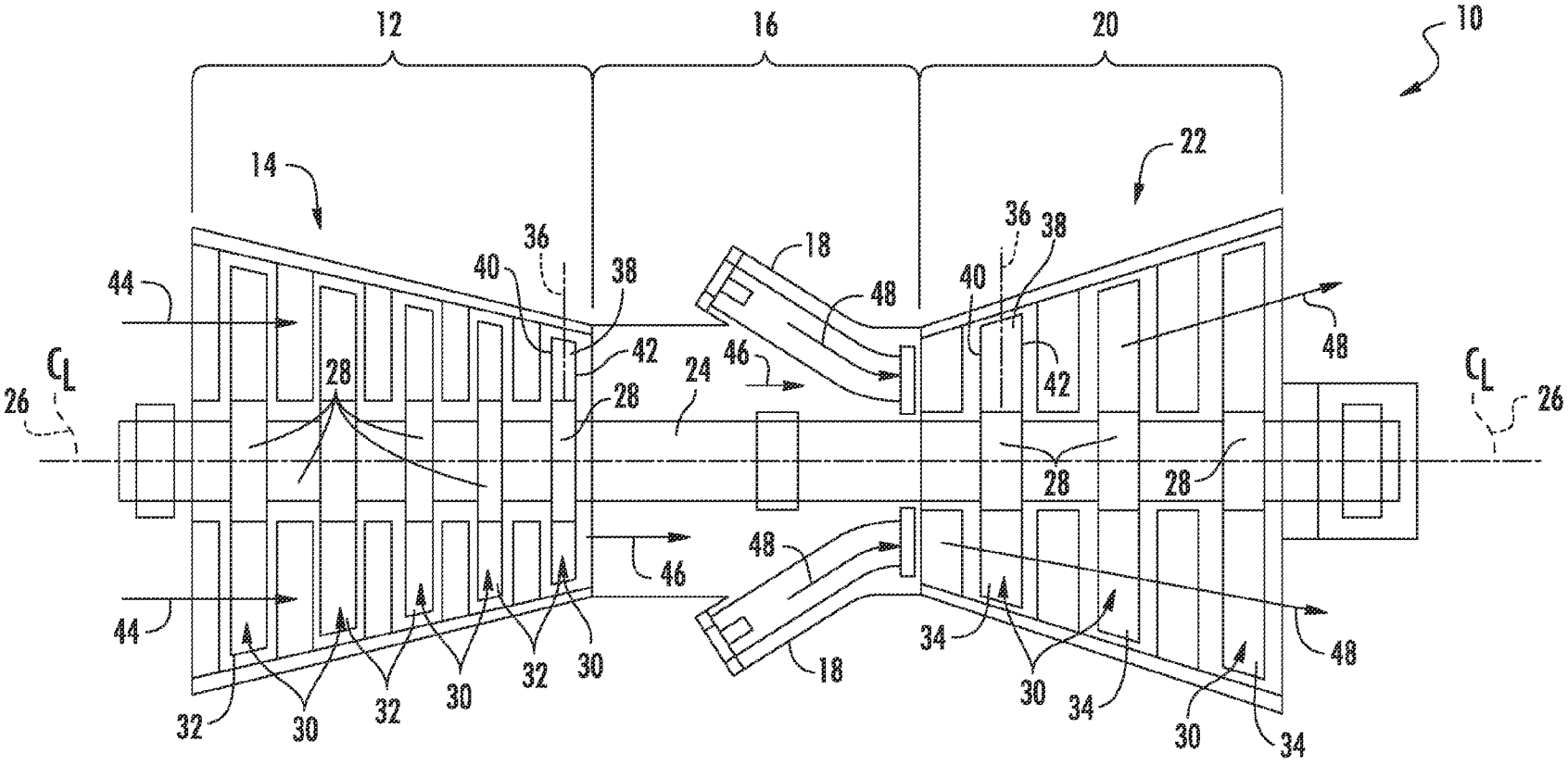
FIG. 1 (PRIOR ART)
FIG. 1 is a functional diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a gas turbine for purposes of illustration, one of ordinary skill in the art will readily appreciate that embodiments of the present invention may be applied to any turbomachine having a shaft and rotating blades coupled to the shaft such as a steam turbine or the like, and are not limited to a gas turbine unless specifically recited in the claims.

Referring now to the drawings, wherein identical numerals indicate the same elements throughout the figures, FIG. 1 provides a functional diagram of one embodiment of a turbomachine, in this case an exemplary gas turbine 10 that, may incorporate various embodiments of the present invention. It should be understood that the present disclosure is not limited to gas turbines, and rather that steam turbines or any other suitable turbomachines are within the scope and spirit of the present disclosure. As shown, the gas turbine 10 generally includes a compressor section 12 including a compressor 14 disposed at an upstream end of the gas turbine 10, a combustion section 16 having at least one combustor 18 downstream from the compressor 14, and a turbine section 20 including a turbine 22 that is downstream from the combustion section 16. A shaft 24 extends along an axial centerline 26 of the gas turbine 10 at least partially through the compressor 14 and/or the turbine 22. In particular configurations, the shaft 24 may comprise of a plurality of individual shafts.

Multiple rotor wheels or disks 28 are disposed coaxially along the shaft 24 within the compressor 14 and/or the turbine 22. Each rotor disk 28 is configured to receive a plurality of radially extending rotor blades 30 that are circumferentially spaced around and removably fixed to the rotor disk 28. The rotor blades 30 may be configured for use within the compressor 14 such as a compressor rotor blade 32 or for use within the turbine 22 such as a turbine bucket or turbine rotor blade 34. Each blade 30 has a longitudinal centerline axis 36 and includes an airfoil portion 38 having a leading edge 40 and a trailing edge 42.

In operation, a working fluid 44 such as air is routed into the compressor 14 where it is progressively compressed in part by the compressor rotor blades 32 as it is routed towards the combustion section 16. A compressed working fluid 46 flows from the compressor 14 and is supplied to the combustion section 16. The compressed working fluid 46 is distributed to each of the combustors 18 where it is mixed with a fuel to provide a combustible mixture. The combustible mixture is burned to produce combustion gases 48 at a relatively high temperature and high velocity. The combustion gases 48 are routed through the turbine 22 where thermal and kinetic energy is transferred to the turbine rotor blades 34, thereby causing the shaft 24 to rotate. In particular applications, the shaft 24 is coupled to a generator (not shown) to produce electricity.

Figure 2:
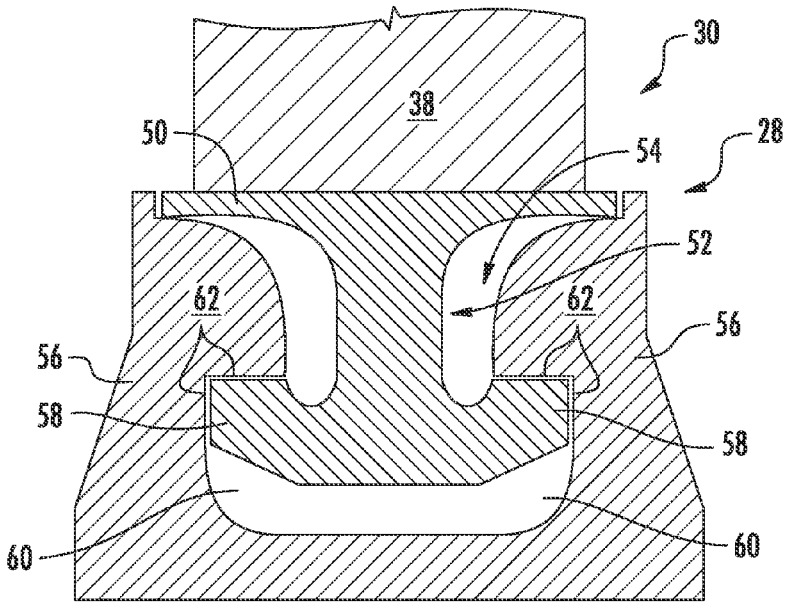
FIG. 2 is a partial sectional view of an embodiment of a root and attachment slot configuration for circumferential entry rotor blades.

FIG. 2 is an enlarged cross section view of a portion of an exemplary rotor disk 28 including an exemplary rotor blade 30 having a T-type root and attachment slot configuration. As shown in FIG. 2, each rotor blade 30 also may include a platform 50 that provides a portion of a radially inner boundary for airflow, combustion gas flow or other fluid flow such as steam over the airfoils 38 during operation of the gas turbine 10. In addition, each rotor blade 30 includes an integral root portion 52 that extends radially inward from the platform 50. The root portion 52 slides into and along a circumferentially extending attachment slot 54 defined by forward and aft post or hoop components 56 of the rotor disk 28, as is generally known in the art.

The root portion 52 may include protrusions 58 that are received into lateral recesses 60 defined within the attachment slot 54 and at least partially defined by recessed wall portions 62 of the hoop components 56. It should be readily appreciated that the configuration of the root portion 52 and attachment slot 54 provided in FIG. 2 is for illustrative purposes only, and that the root and slot configuration may vary widely within the scope and spirit of the present subject matter.

Figure 3:
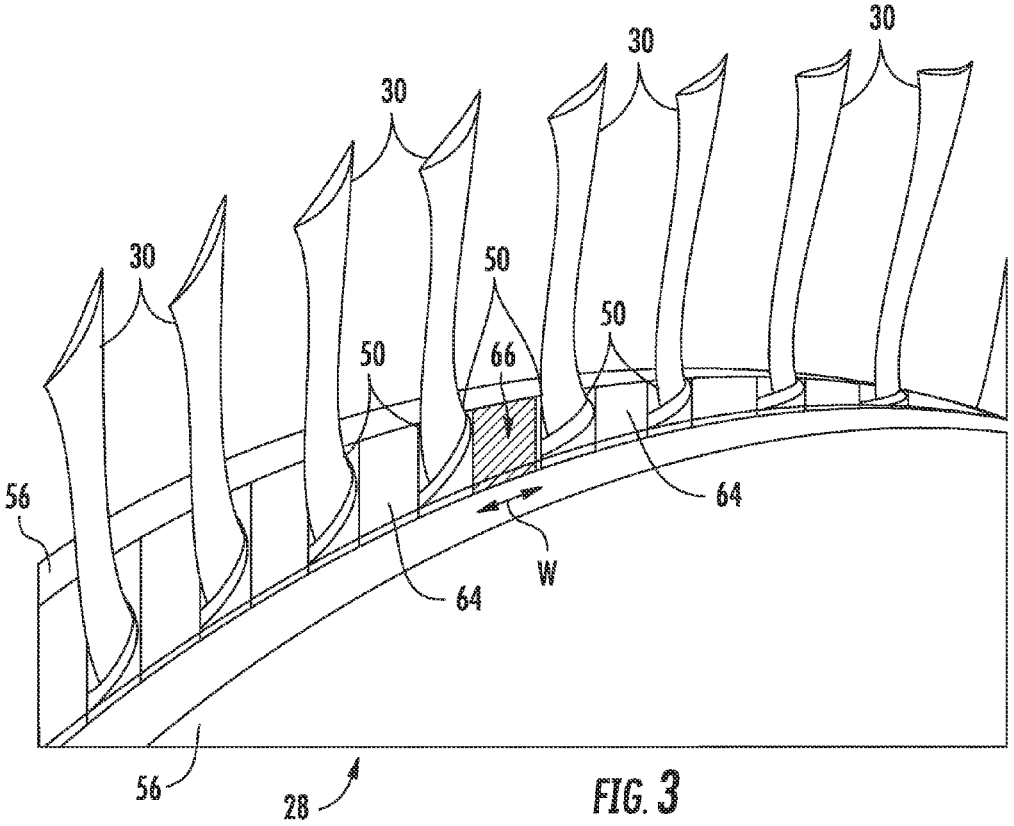
FIG. 3 is a partial perspective view of an exemplary rotor disk including final or load-in spaces into which a locking spacer assembly may be inserted.

FIG. 3 is a partial perspective view of a portion of an exemplary rotor disk 28, and particularly illustrates a plurality of the rotor blades 30 configured in an attachment slot 54 (FIG. 2) between the forward and aft hoop components 56 of the rotor disk 28. As shown, each of the rotor blades 30 includes a platform 50. As shown in FIG. 3, conventional spacers 64 are disposed between the platforms 50 of adjacent rotor blades 30, as is generally known in the art.

Final or load-in spaces 66, having a circumferential width W between adjacent rotor blade 30 platforms 50, can be filled by various embodiments of a locking spacer assembly 100 as shown in FIGS. 4-11, which is described in greater detail below. The final or load-in spaces 66 are generally used to insert the rotor blades 30 into the attachment slot 54 during assembly and/or disassembly of the rotor blades 30 to the rotor disk 28. It should be appreciated that in particular embodiments, the locking spacer assembly 100 can be used to fill final spaces 66 between platforms 50 of adjacent rotor blades 30 including the compressor rotor blades 32 located within the compressor 14 and/or the turbine rotor blades 34 located within the turbine 22. As such, the locking spacer assembly 100 will be generally described below as being installed between platforms 50 of adjacent rotor blades 30, wherein the platforms 50 and rotor blades 30 may be part of a compressor rotor blade 32 or a turbine rotor blade 34 so as to fully encompass both applications.

Figure 4:
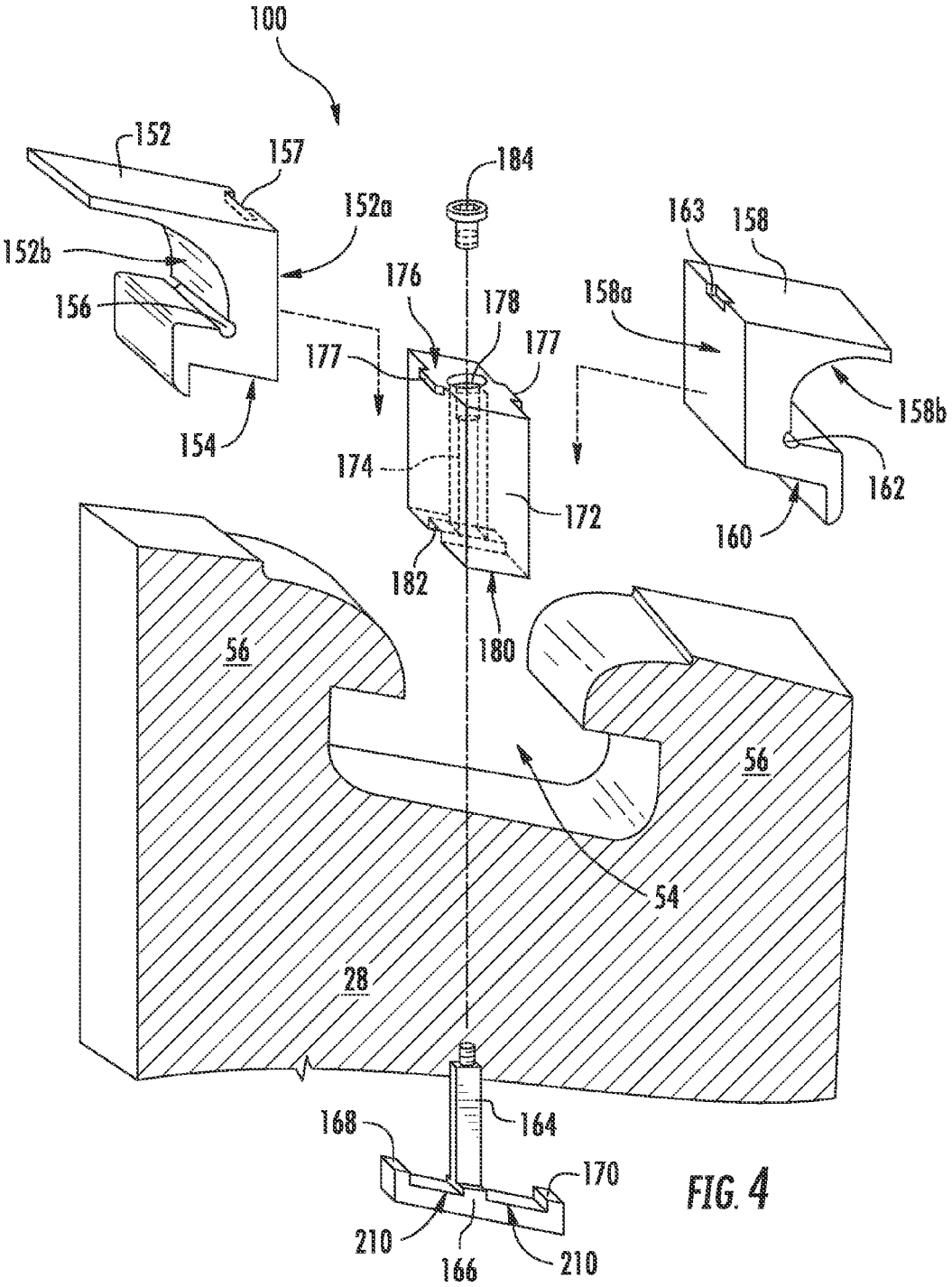
FIG. 4 is an exploded view of the components of an embodiment of the locking spacer assembly in accordance with aspects of the present subject matter.

Referring to FIG. 4, an embodiment of the locking spacer assembly 100 is illustrated in an exploded view. The assembly 100 includes a first end piece 152 and a second end piece 158 configured to fit into the final spaces 66 between platforms 50 of adjacent rotor blades 30. The end pieces 152, 158, thus, have any dimensional configuration such that the width, length, thickness, or any other characteristics enables the end pieces 152, 158 to be inserted between the platforms 50. For example, the end pieces 152, 158 may generally have a horizontal width W (FIG. 3) in order to fit snugly between the platforms 50 of adjacent airfoils.

Figure 5:
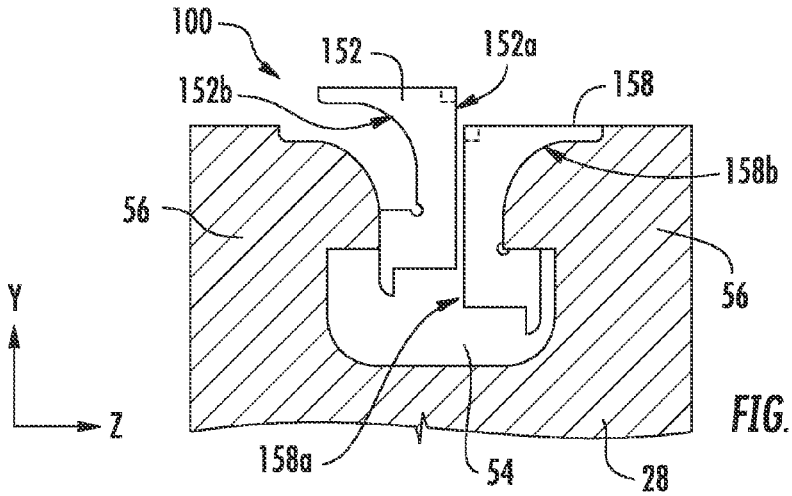
FIG. 5, FIG. 6, FIG. 7, and FIG. 8 are sequential assembly views of an embodiment of a locking spacer assembly in accordance with aspects of the present subject matter.

The first end piece 152 includes an inner surface 152*a* and an outer surface 152*b*. Similarly, the second end piece 158 includes an inner surface 158*a* and an outer surface 158*b*. Outer surfaces 152*b*, 158*b* have a profile generally adapted to project into the attachment slot 54, as generally illustrated in FIG. 5. For example, the profile of the outer surfaces 152*b*, 158*b* may have a top portion that is substantially curved to mirror the curve of the hoop components 56. Moreover, the profile may have a bottom portion that extends outwardly at the corner formed between the hoop components 56 and the lateral recesses 60 to project into the illustrated t-type attachment slot 54. However, it should be readily appreciated that outer surfaces 152*b*, 158*b* can have any desired profile and need not have the particular profile illustrated in FIG. 4 and FIG. 5. The profile of outer surfaces 152*b*, 158*b* will depend in large part on the particular shape and configuration of the attachment slot 54.

It may also be desirable to provide arcuate grooves 156, 162 on the outer surfaces 152*b*, 158*b*, respectively. For example, the arcuate grooves 156, 162 may be included to provide a point of low stress or a location for stress relief on the end pieces 152, 158. As illustrated, the arcuate grooves 156, 162 are located on the outer surfaces 152*b*, 158*b* at the corner formed between the hoop components 56 and the lateral recesses 60.

Figure 6:
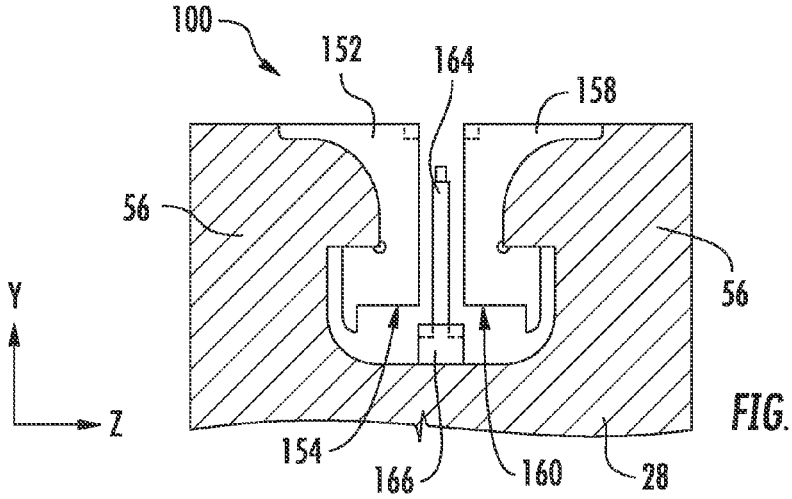
Figure 7:
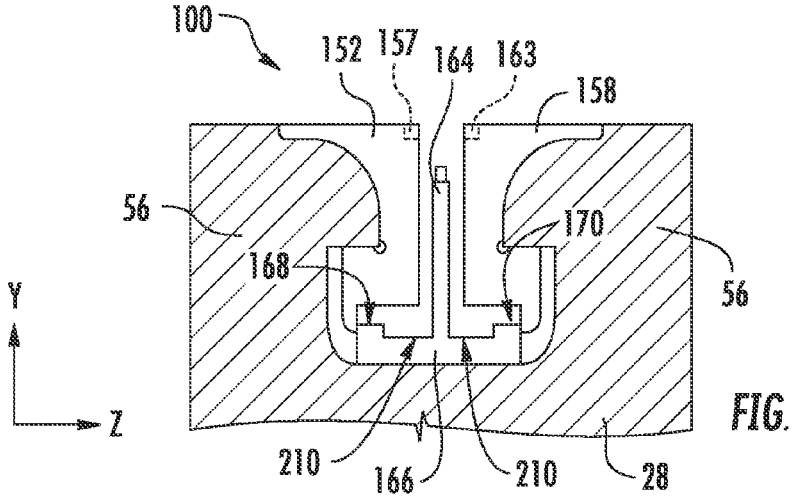

In the illustrated embodiment, the inner surfaces 152*a*, 158*a* generally face towards each other when the end pieces 152, 158 are inserted into the attachment slot 54, as is generally illustrated in FIG. 6. Preferably, planes 154, 160 form part of an indentation in the inner surfaces 152*a*, 158*a*, respectively and are defined by an angle relative to radial. As illustrated, the angle relative to radial is advantageously a generally perpendicular angle. For example, the angle of planes 154, 160 can be between 86 degrees and 94 degrees, such as between approximately 89 degrees and approximately 91 degrees, such as approximately 90 degrees, relative to radial.

Additionally, recesses 157, 163 may be formed on the inner surfaces 152*a*, 158*a*, respectively. As illustrated in FIG. 4, the recesses 157, 163 are formed in the inner surfaces 152*a*, 158*a* at the top of the end pieces 152, 158. The recesses 157, 163, which may for example be rectangular as shown, may be configured to receive complimentary collars 177 of a spacer block, as will be discussed below. Thus, it should be appreciated that the shape, depth, and location of the recesses 157, 163 may vary depending on the configurations of the complimentary rectangular collars 177.

Figure 10:
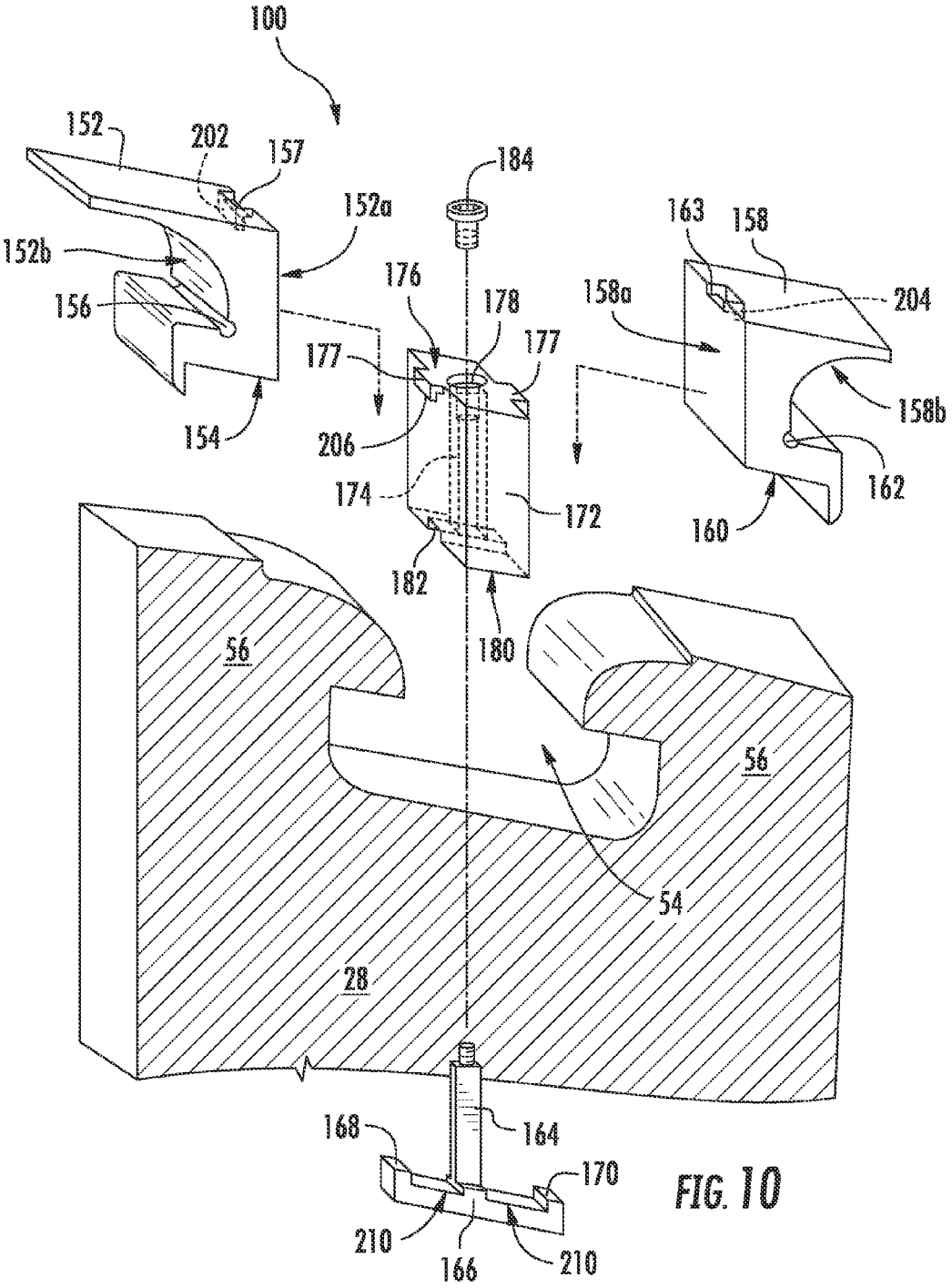
FIG. 10 is an exploded view of the components of another embodiment of the locking spacer assembly in accordance with aspects of the present subject matter.
Figure 11:
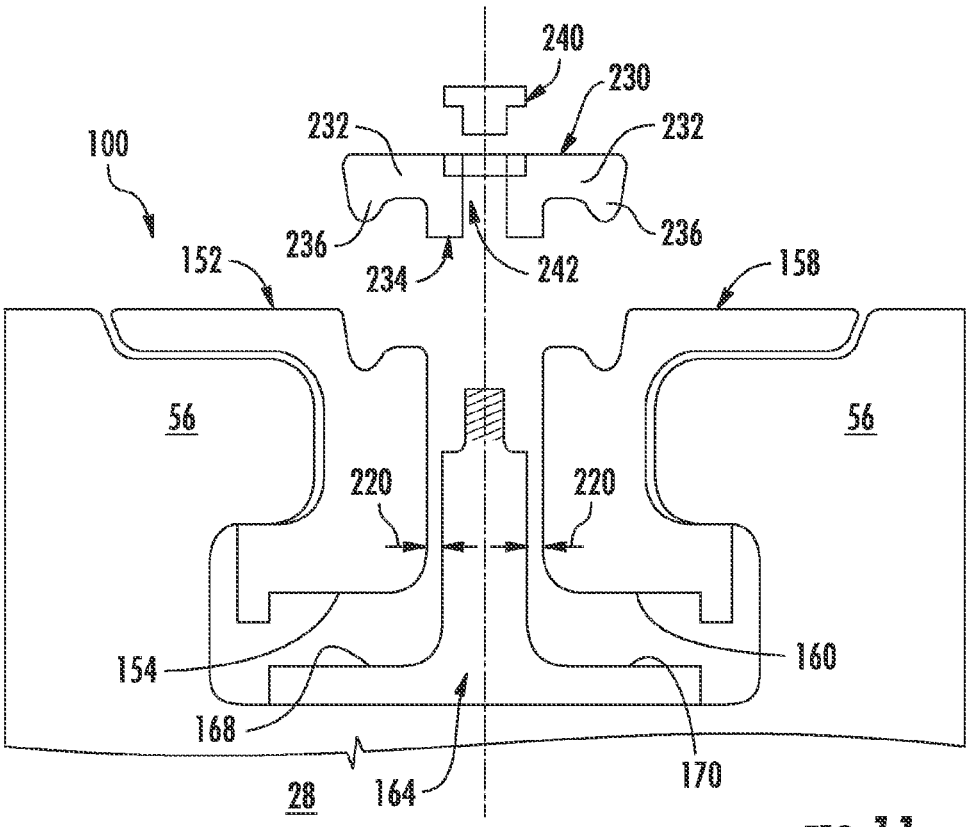
FIG. 11 is an exploded view of the components of another embodiment of the locking spacer assembly in accordance with aspects of the present subject matter.

Further, in some embodiments as illustrated in FIGS. 10 and 11, recesses 157, 163 may include generally radial depressions 202, 204. Such depressions may extend radially inward from the recesses 157, 163, and may be configured to receive complementary protrusions 206 extending radially inward from collars 177 of the spacer block, as will be discussed below. Thus, it should be appreciated that the shape, depth, and location of the depressions 202, 204 may vary depending on the configurations of the complimentary protrusions 206.

The locking spacer assembly 100 also includes an actuator 164 movable between the inner surfaces 152*a*, 158*a* and configured to engage such inner surfaces 152*a*, 158*a*. Preferably, the actuator 164 includes a projection 166 configured to engage the inner surfaces 152*a*, 158*a*. In the illustrated embodiment, the projection 166 extends outward from the base of the actuator 164 in opposing directions such that the actuator is T-shaped. The projection 166 may include surfaces 168, 170, which are defined by an angle relative to radial, which may be generally perpendicular as discussed above relative to the planes 154, 160. Generally, the angled surfaces 168, 170 may have a shape and angle that conforms to the shape and angles of the planes 154, 160 forming part of the indentation in the inner surfaces 152*a*, 158*a*.

Additionally, in some embodiment as shown the projection 166 may include recessed portions 210 defined adjacent to the surfaces 168, 170, such as between the surfaces 168, 170 in the generally lateral direction. These recessed portions 210 prevent contact between the projection 166 and the planes 154, 160 at locations other than those of the surfaces 168, 170. Use of such recessed portion 210 advantageously directs and positions the location of radial loading between the surfaces 168, 170 and the planes 154, 160. Further, use of such recessed portion 210 advantageously directs and positions the location of radial loading through surfaces 168, 170 and the planes 154, 160 with the location of radial loading of pressure faces of the first end piece 152 and second end piece 158 on recessed wall portions 62, such as at post locations 188 (discussed herein, see FIG. 9).

Figure 8:
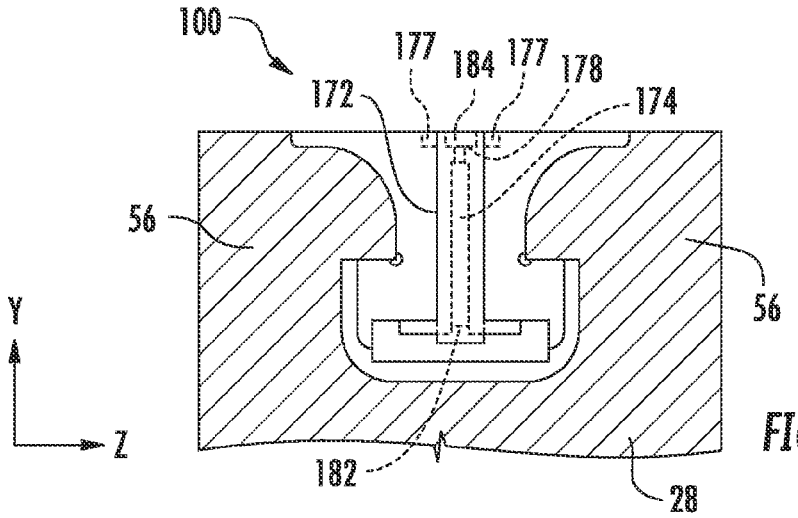
Figure 9:
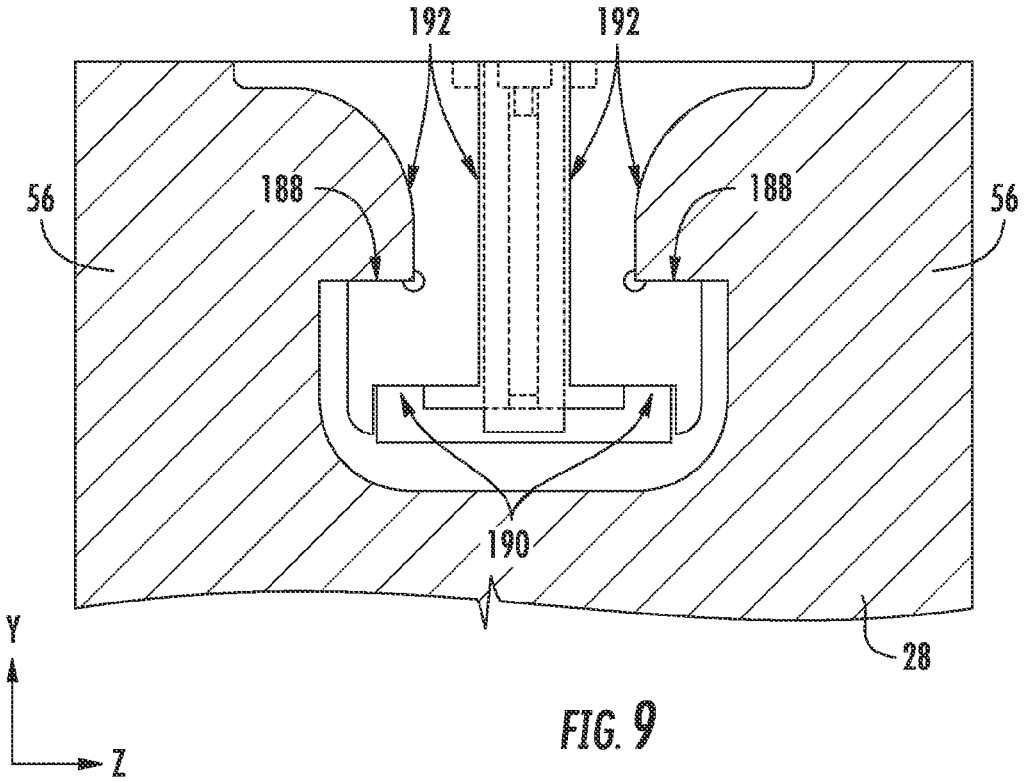
FIG. 9 is a sectional view of an assembled embodiment of a locking spacer assembly in accordance with aspects of the present subject matter indicating the locations of rotational loading.

Referring to FIG. 4, FIG. 8 and FIG. 9, the locking spacer assembly may also include a spacer block 172 and a fastener 184. As illustrated, the spacer block 172 is configured to be inserted between the inner surfaces 152*a*, 158*a* and includes a cavity 174 (shown by hidden lines in FIG. 4 and FIG. 8) configured to receive the actuator 164. Similar to the end pieces 152, 158, the spacer block 172 is also configured to fit between the platforms 50 of adjacent rotor blades 30. Thus, the spacer block 172 may have any dimensional configuration such that the width, length, thickness, or any other characteristic enables the spacer block 172 to be inserted between the platforms 50 when disposed between inner surfaces 152*a*, 158*a*. For example, the spacer block 172 may generally have a horizontal width W (FIG. 3) in order to fit snugly between the platforms 50.

The spacer block 172 may also include collars 177 extending laterally from the top of the spacer block 172. The collars 177 may be configured to be received in the recesses 157, 163 formed in the inner surfaces 152*a*, 158*a*. As illustrated in FIG. 8, the collars 177 slide into the recesses 157, 163 when the spacer block 172 is inserted between the inner surfaces 152*a*, 158*a*, which can prevent relative movement between the spacer block 172 and the first and second end pieces 152, 158.

Additionally, in some embodiments as shown in FIG. 10, collars 177 may include protrusions 206 extending radially therefrom. The protrusions 206 may be configured to be received in the depressions 202, 204 extending from recesses 157, 163. As illustrated, the protrusions 206 slide into the depressions 202, 204 when the spacer block 172 is inserted between the inner surfaces 152*a*, 158*a*, which can prevent the spacer block 172 from falling radially down in the attachment slot 54, and can further prevent lateral relative movement of the end pieces 52, 58 and spacer block 172.

The spacer block 172 may also include an opening 178 and a channel 182. The opening 178 is defined in a top surface 176 of the spacer block 172 and is configured to receive the fastener 184. For example, the fastener 184 may fit into opening 178 such that the fastener 184 is positioned generally flush with the platforms 50 when the locking spacer assembly 100 is locked within the attachment slot 54. The channel 182 is defined in a bottom surface 180 of the spacer block 172 and is configured to receive a portion of the actuator 164. Specifically, as illustrated in FIG. 8, the channel 182 slides over a portion of the projection 166 when locking spacer assembly 100 is assembled. It should be appreciated that the opening 178 and channel 182 need not have the particular shape, depth or width as is generally illustrated. The shape, width and depth of the opening 178 and channel 182 may be varied to accommodate varying shapes and sizes of fasteners and actuators.

The fastener 184 is configured to secure the spacer block 172 to the actuator 164. Thus, the fastener 184 can be used to prevent the actuator 164 from falling radially down into the attachment slot 136. It should be appreciated by one of ordinary skill in the art that the fastener 184 may generally comprise any locking mechanism that may be used to secure the spacer block 172 to the actuator 164. In the illustrated embodiment, the fastener 184 has a threaded female end which can be screwed onto a threaded male end of the actuator 164.

FIG. 5, FIG. 6, FIG. 7 and FIG. 8 illustrate sequential assembly views of one embodiment of the locking spacer assembly 100. As depicted therein, the locking spacer assembly 100 defines a direction Y and a direction Z perpendicular to direction Y. Initially, the end pieces 152, 158 may be inserted into the attachment slot 54 and spaced apart such that the actuator 164 can be inserted between the inner surfaces 152*a*, 158*a*. Once inserted between the inner surfaces 152*a*, 158*a*, the actuator 164 is rotated ninety degrees so that the generally perpendicular surfaces 168, 170 of the projection 166 generally face the generally perpendicular planes 154, 160 of the inner surfaces 152*a*, 158*a*, The spacer block 172 can then be inserted between the inner surfaces 152*a*, 158*a*, with the collars 177 of the spacer block 172 being received into the complimentary rectangular recesses 157, 163 of the inner surfaces 152*a*, 158*a*. The actuator 164 is then pulled radially outward (in direction Y) by hand until the surfaces 168, 170 engage the planes 154, 160. The fastener 184 may then be applied to secure the actuator 164 to the spacer block 174 and prevent the actuator 164 from falling radially down.

Upon installation of the fastener 184, the locking spacer assembly 100 remains locked together within the attachment slot 54, albeit in a somewhat loose state. However, as the rotor disc 28 rotates during operation of the turbine engine, rotational loading on the assembly components cause the assembly 100 to lock together tightly within the attachment slot 54. Specifically, the radial load on the actuator 164 caused by rotation of the rotor disc 28 is transferred through the end pieces 152, 158 to the rotor disc 28 to tightly lock the assembly within the attachment slot 54.

FIG. 9 illustrates the locations of rotational loading on the various components of the locking spacer assembly 100 during operation of a conventional gas turbine. Upon rotation of the rotor disc 28, end pieces 152, 158 load radially (in direction Y) on the hoop components 56 of the disc 28 at post locations 188. Simultaneously, rotation of the rotor disc 28 causes rotational loading on the spacer block 172, which is transmitted through the fastener 184 to the actuator 164. Due to the rotational loading resulting from centrifugal forces, the actuator 164 moves radially outward engaging the end pieces 152, 158 at the projection locations 190. Since the projection locations 90 are generally perpendicular to radial, all or substantially of the load from the actuator 164 is transmitted radially through end pieces 152, 158.

As illustrated in FIG. 9, the components of the locking spacer assembly 100, once assembled, may have tolerance. However, it is desirable to have each component fit snugly within the attachment slot 54 such that the components of the locking spacer assembly 100 substantially fill the width of the attachment slot 54 between the hoop components 56. For example, tight tolerances result in a snug fit at the tolerance locations 192. Additionally, tight tolerances can prevent significant rotation of the locking spacer assembly 100, thereby creating an anti-rotation feature.

Referring now to FIG. 11, an alternative embodiment of the locking spacer assembly 100 of the present disclosure is illustrated. In this embodiment, a spacer block 172 is not required. Actuator 164 may, as discussed above, be movable between the inner surface 152*a*, 158*a* and configured to engage such inner surface 152*a*, 158*a*. In some embodiments, actuator 164 may contact inner surfaces 152*a*, 158*a* when the locking spacer assembly 100 is assembled. In other embodiments, lateral spaces 220 may be defined between the actuator 164 and inner surfaces 152*a*, 158*a*. These lateral spaces 220 may facilitate assembly of the locking spacer assembly 100 by allowing the various components to fit within the attachment slot 54 and fit together with each other.

In the embodiment illustrated in FIG. 11, a collar assembly 230 may additionally be provided, and may be configured for attachment to the actuator 164. Collar assembly 230 may include collars 232 extending laterally from a central portion 234. The collars 232 may be configured to be received in the recesses 157, 163 formed in the inner surfaces 152*a*, 158*a*, as discussed above with respect to collars 177.

Additionally, in some embodiments as shown in FIG. 10, collars 232 may include protrusions 236 extending radially therefrom. The protrusions 236 may be configured to be received in the depressions 202, 204 extending from recesses 157, 163, as discussed above with respect to protrusions 206.

A fastener 240 may be configured to secure the collar assembly 230 to the actuator 164. Thus, the fastener 240 can be used to prevent the actuator 164 from falling radially down into the attachment slot 136. It should be appreciated by one of ordinary skill in the art that the fastener 240 may generally comprise any locking mechanism that may be used to secure the collar assembly to the actuator 164. In the illustrated embodiment, the fastener 240 has a threaded female end which can be screwed onto a threaded male end of the actuator 164, which may extend through a central bore hole 242 defined in the collar assembly 230.

It should be appreciated that the present subject matter also encompasses a rotor assembly incorporating a locking spacer assembly 100 as described and embodied herein. The rotor assembly includes a rotor disc 28 with forward and aft posts 56 defining a continuous circumferentially extending attachment slot 54. The rotor assembly also includes a plurality of rotor blades 30, with each rotor blade 30 extending from a platform 50. The platform 50 is secured within the attachment slot 54 by an inwardly extending root 52. At least one locking spacer assembly 100 in accordance with any of the embodiments illustrated or described herein is disposed in a space 66 between two of the platforms 50. It should be readily appreciated, as indicated above, that the rotor assembly may be disposed in the compressor or turbine section of a gas turbine, with the platforms 50 and rotor blades 30 being part of a complete stage of either rotor blades or turbine buckets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A locking spacer assembly for insertion into a circumferential attachment slot between platforms of adjacent rotor blades, comprising:

a first end piece configured to fit into a space between platforms of the adjacent rotor blades, the first end piece comprising an outer surface, an inner surface, and a first plane oriented generally perpendicular to a radial direction, the outer surface having a profile adapted to project into the attachment slot;

a second end piece configured to fit into the space between the platforms, the second end piece comprising an outer surface, an inner surface, and a second plane oriented generally perpendicular to the radial direction, the outer surface having a profile adapted to project into the attachment slot, wherein the inner surfaces of the first and second end pieces generally face each other;

an actuator movable between the inner surfaces, the actuator comprising a projection, the projection comprising a first surface and a second surface formed on the projection that respectively engage the first plane and the second plane, the first and second surfaces generally perpendicular to the radial direction; and a recess defined laterally between the first surface and the second surface, radially between the first plane and the projection, and radially between the second plane and the projection.

2. The locking spacer assembly of claim 1, further comprising a spacer block configured to be inserted between the inner surfaces, the spacer block defining a cavity configured to receive the actuator.

3. The locking spacer assembly of claim 2, further comprising a fastener configured to secure the spacer block to the actuator.

4. The locking spacer assembly of claim 2, further defining recesses formed in the inner surfaces of the first and second end pieces, and wherein the spacer block further comprises laterally extending collars, wherein the collars are configured to be received in the recesses when the spacer block is inserted between the inner surfaces.

5. The locking spacer assembly of claim 4, further defining depressions extending radially from the recesses, and further comprising protrusions extending radially from the collars, wherein the protrusions are configured to be received in the depressions when the spacer block is inserted between the inner surfaces.

6. The locking spacer assembly of claim 1, further comprising a collar assembly, the collar assembly configured for attachment to the actuator.

7. The locking spacer assembly of claim 6, further comprising a fastener configured to secure the collar assembly to the actuator.

8. The locking spacer assembly of claim 6, further defining recesses formed in the inner surfaces of the first and second end pieces, and wherein the collar assembly further comprises laterally extending collars, Wherein the collars are configured to be received in the recesses when the spacer block is inserted between the inner surfaces.

9. The locking spacer assembly of claim 7, further defining depressions extending radially from the recesses, and further comprising protrusions extending radially from the collars, wherein the protrusions are configured to be received in the depressions when the spacer block is inserted between the inner surfaces.

10. A rotor assembly, comprising:

a rotor disc comprising forward and aft posts defining a continuous circumferentially extending attachment slot;

a plurality of rotor blades, each of the plurality of rotor blades extending from one of a plurality of platforms, wherein each of the plurality of platforms is secured to the attachment slot by an inwardly extending root; and a locking spacer assembly disposed in a space between at least two of the plurality of platforms, the locking spacer assembly comprising:

a first end piece configured to fit into a space between platforms of the adjacent rotor blades, the first end piece comprising an outer surface, an inner surface, and a first plane oriented generally perpendicular to a radial direction, the outer surface having a profile adapted to project into the attachment slot;

a second end piece configured to fit into the space between the platforms, the second end piece comprising an outer surface, an inner surface, and a second plane oriented generally perpendicular to the radial direction, the outer surface having a profile adapted to project into the attachment slot, wherein the inner surfaces of the first and second end pieces generally face each other;

an actuator movable between the inner surfaces, the actuator comprising a projection, the projection comprising a first surface and a second surface formed on the projection that respectively engage the first plane and the second plane, the first and second surfaces generally perpendicular to the radial direction; and a recess defined laterally between the first surface and the second surface, radially between the first plane and the projection, and radially between the second plane and the projection.

11. The rotor assembly of claim 10, further comprising a spacer block configured to be inserted between the inner surfaces, the spacer block defining a cavity configured to receive the actuator.

12. The rotor assembly of claim 11, further defining recesses formed in the inner surfaces of the first and second end pieces, and wherein the spacer block further comprises laterally extending collars, Wherein the collars are configured to be received in the recesses when the spacer block is inserted between the inner surfaces.

13. The rotor assembly of claim 10, further comprising a collar assembly, the collar assembly configured for attachment to the actuator.

14. The rotor assembly of claim 13, further defining recesses formed in the inner surfaces of the first and second end pieces, and wherein the collar assembly further comprises laterally extending collars, wherein the collars are configured to be received in the recesses when the spacer block is inserted between the inner surfaces.

15. A turbomachine, comprising:

a compressor section;

a turbine section; and a combustor section between the compressor section and the turbine section, wherein one of the compressor section or the turbine section comprises:

a rotor disc comprising forward and aft posts defining a continuous circumferentially extending attachment slot;

a plurality of rotor blades, each of the plurality of rotor blades extending from one of a plurality of platforms, wherein each of the plurality of platforms is secured to the attachment slot by an inwardly extending root; and a locking spacer assembly disposed in a space between at least two of the plurality of platforms, the locking spacer assembly comprising:

a first end piece configured to fit into a space between platforms of the adjacent rotor blades, the first end piece comprising an outer surface, an inner surface, and a first plane oriented generally perpendicular to a radial direction, the outer surface having a profile adapted to project into the attachment slot;

a second end piece configured to fit into the space between the platforms, the second end piece comprising an outer surface, an inner surface, and a second plane oriented generally perpendicular to the radial direction, the outer surface having a profile adapted to project into the attachment slot, wherein the inner surfaces of the first and second end pieces generally face each other;

an actuator movable between the inner surfaces, the actuator comprising a projection, the projection comprising a first surface and a second surface formed on the projection that respectively engage the first plane and the second plane, the first and second surfaces generally perpendicular to the radial direction; and a recess defined laterally between the first surface and the second surface, radially between the first plane and the projection, and radially between the second plane and the projection.

* * * * *